US011092163B2

(12) United States Patent
Iwakiri

(10) Patent No.: US 11,092,163 B2
(45) Date of Patent: Aug. 17, 2021

(54) COMPRESSOR AND TURBOCHARGER

(71) Applicant: MITSUBISHI HEAVY INDUSTRIES ENGINE & TURBOCHARGER, LTD., Sagamihara (JP)

(72) Inventor: Kenichiro Iwakiri, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 6 days.

(21) Appl. No.: 16/465,381

(22) PCT Filed: Feb. 8, 2017

(86) PCT No.: PCT/JP2017/004610
§ 371 (c)(1),
(2) Date: May 30, 2019

(87) PCT Pub. No.: WO2018/146752
PCT Pub. Date: Aug. 16, 2018

(65) Prior Publication Data

US 2020/0003223 A1 Jan. 2, 2020

(51) Int. Cl.
*F04D 29/30* (2006.01)
*F04D 29/28* (2006.01)

(52) U.S. Cl.
CPC ..... *F04D 29/30* (2013.01); *F04D 29/284* (2013.01); *F05D 2220/40* (2013.01)

(58) Field of Classification Search
CPC .... F04D 29/30; F04D 29/284; F04D 29/4206; F04D 29/324; F04D 29/685;
(Continued)

(56) References Cited

U.S. PATENT DOCUMENTS 1,317,707 A * 10/1919 Johnson ..... B64C 27/463 416/228
4,086,022 A 4/1978 Freeman et al.
(Continued)

FOREIGN PATENT DOCUMENTS

CN 104704244 A 6/2015
CN 105518306 A 4/2016
(Continued)

OTHER PUBLICATIONS

Extended European Search Report dated Oct. 9, 2019 issued to the corresponding European Application No. 17895529.0.
(Continued)

*Primary Examiner* — Courtney D Heinle
*Assistant Examiner* — Danielle M. Christensen
(74) *Attorney, Agent, or Firm* — Birch, Stewart, Kolasch & Birch, LLP.

(57) ABSTRACT

A compressor comprises: a rotor including a hub and a blade provided on an outer peripheral surface of the hub; and a casing surrounding the rotor so as to face a tip of the blade across a gap. Provided that the gap between the tip of the blade and the casing has a size t0 at a leading edge of the blade, the gap between the tip of the blade and the casing has a size larger than t0 in at least a partial range downstream of the leading edge in an axial direction of the rotor.

7 Claims, 12 Drawing Sheets

(58) Field of Classification Search
CPC ..... F04D 29/162; F04D 29/164; F04D 29/38; F04D 29/384; F04D 29/242; F04D 29/40; F04D 15/0033; F05D 2220/40; F05D 2240/307; F05D 2250/712; F05D 2250/294; F01D 5/20; F01D 5/141
See application file for complete search history.

(56) References Cited

U.S. PATENT DOCUMENTS

| | | | | |
|---|---|---|---|---|
| 4,540,335 | A | 9/1985 | Yamaguchi et al. | |
| 6,099,249 | A | 8/2000 | Hashimoto | |
| 6,338,609 | B1 | 1/2002 | Decker et al. | |
| 8,414,249 | B2 * | 4/2013 | Nikpour | F04D 29/4213 415/1 |
| 9,377,029 | B2 | 6/2016 | Hofmann et al. | |
| 2003/0138317 | A1 | 7/2003 | Barnett et al. | |
| 2007/0098562 | A1 * | 5/2007 | Tudor | F01D 5/20 416/236 R |
| 2010/0266410 | A1 | 10/2010 | Amaral et al. | |
| 2012/0328447 | A1 * | 12/2012 | Hofmann | F01D 5/20 416/235 |
| 2015/0226078 | A1 | 8/2015 | Perrot et al. | |
| 2016/0222977 | A1 | 8/2016 | Pagnier | |
| 2016/0238019 | A1 * | 8/2016 | Kobayashi | F04D 17/12 |
| 2017/0198712 | A1 * | 7/2017 | Berenyi | F04D 29/284 |
| 2017/0254340 | A1 * | 9/2017 | Raghavan | F04D 29/164 |

FOREIGN PATENT DOCUMENTS

| | | | | |
|---|---|---|---|---|
| DE | 10 2013 201 771 | A1 | 8/2014 | |
| EP | 2 538 024 | A1 | 12/2012 | |
| EP | 3594506 | A1 * | 1/2020 | F04D 29/701 |
| JP | 52-40809 | A | 3/1977 | |
| JP | 57-95500 | U | 6/1982 | |
| JP | 60-124599 | U | 8/1985 | |
| JP | 61-73099 | U | 5/1986 | |
| JP | 8-303389 | A | 11/1996 | |
| JP | 2954539 | B2 | 9/1999 | |
| JP | 2000-170695 | A | 6/2000 | |
| JP | 2001-280295 | A | 10/2001 | |
| JP | 2004-124813 | A | 4/2004 | |
| JP | 2010-249138 | A | 11/2010 | |
| JP | 2013-194558 | A | 9/2013 | |
| JP | 2014-173427 | A | 9/2014 | |
| JP | 2014-214649 | A | 11/2014 | |
| JP | 2015-531447 | A | 11/2015 | |
| JP | 2015-214649 | A | 12/2015 | |

OTHER PUBLICATIONS

International Preliminary Report on Patentability and Written Opinion of the International Searching Authority dated Aug. 22, 2019, for International Application No. PCT/JP2017/004610, with an English Translation.

International Search Report, dated Mar. 28, 2017, for International Application No. PCT/JP2017/004610.

Office Action dated Mar. 30, 2020 issued in counterpart Chinese Application No. 201780075347.4 with an English Translation.

Office Action dated Jun. 23, 2020 issued in counterpart EPC Application No. 17895529.0.

Office Action dated Jun. 23, 2020 issued in counterpart Japanese Application No. 2018-566692.

* cited by examiner

COMPRESSOR AND TURBOCHARGER

TECHNICAL FIELD

The present disclosure relates to a compressor and a turbocharger.

BACKGROUND

In a centrifugal compressor and an axial compressor, a leakage flow from a pressure surface toward a suction surface in a gap between a tip of a blade and a casing (hereinafter referred to as a "clearance flow") is a factor influencing the efficiency.

A boundary layer developed on the suction surface of the blade (a low-energy fluid) is accumulated in the vicinity of the tip of the blade due to the action of a centrifugal force and is whirled up by the clearance flow, thereby forming a vortex (hereinafter referred to as a "blade tip leakage vortex"). The low-energy fluid is accumulated at a vortex center of the blade tip leakage vortex, and a reverse flow may be generated, especially on a high-pressure operating point, as the accumulated low-energy fluid is overpowered by a pressure increase (adverse pressure gradient). This phenomenon, called a "vortex breakdown", can be a major factor for an occurrence of a loss.

To suppress such an occurrence of a loss, efforts have been made to suppress the clearance flow itself. For example, a blade described in Patent Document 1 aims to suppress the clearance flow using an eave-shaped tip clearance reduction plate that is formed on an end surface of the blade.

CITATION LIST

Patent Literature

Patent Document 1: JP2004-124813A

SUMMARY

Technical Problem

Forming the eave-shaped tip clearance reduction plate described in Patent Document 1 on the end surface of the blade will complicate the blade structure, and can be a factor for a cost increase. Furthermore, there are cases where, by suppressing the clearance flow, the accumulation of a blade surface boundary layer in the vicinity of the tip of the blade is facilitated, and a vortex may whirl up as a roll-up vortex inside a flow path. Thus, suppression of the clearance flow does not necessarily lead to high efficiency.

At least one embodiment of the present invention has been made in view of the aforementioned conventional problems, and aims to provide a highly efficient compressor and a turbocharger comprising the same.

Solution to Problem (1) A compressor according to at least one embodiment of the present invention comprises: a rotor including a hub and a blade provided on an outer peripheral surface of the hub; and a casing surrounding the rotor so as to face a tip of the blade across a gap. Provided that the gap between the tip of the blade and the casing has a size t0 at a leading edge of the blade, the gap between the tip of the blade and the casing has a size larger than t0 in at least a partial range downstream of the leading edge in an axial direction of the rotor.

According to the compressor described in the above (1), as the size of the gap between the tip of the blade and the casing is kept small at the leading edge of the blade, an increase in a clearance flow in a portion of a blade tip leakage vortex where the vortex starts to whirl up can be suppressed. This can effectively suppress an increase in a loss attributed to the blade tip leakage vortex.

Furthermore, by making the size of the gap relatively large in at least the partial range downstream of the leading edge of the blade as described above, a clearance flow with high energy can be aggressively supplied from a pressure surface of the blade toward a suction surface, at which a low-energy fluid is accumulated, via the gap in at least the partial range mentioned above. This can suppress an increase in the amount of the accumulated low-energy fluid in the vicinity of the tip of the blade. Therefore, by suppressing the breakdown of the blade tip leakage vortex (the occurrence of a reverse flow on a vortex center line) through suppression of the development of a boundary layer on the suction surface of the blade, a reverse flow range in the vicinity of the tip of the blade can be reduced, or the occurrence of a reverse flow can be suppressed.

Furthermore, in a position that is somewhat downstream of the leading edge of the blade, since the pressure difference between the pressure surface and the suction surface is small, even if the gap in at least the partial range mentioned above is made relatively large, the reverse flow range in the vicinity of the tip of the blade can be effectively reduced, or the occurrence of the reverse flow can be effectively suppressed, without excessively increasing the clearance flow from the gap.

As described above, according to the compressor described in the above (1), as the reverse flow range in the vicinity of the tip of the blade can be reduced, or the occurrence of the reverse flow can be suppressed, while suppressing an increase in a loss attributed to the clearance flow, a centrifugal compressor with high efficiency can be realized.

(2) In some embodiments, in the compressor described in the above (1), provided that a meridional length from the leading edge along the tip of the blade is L and that a meridional length from the leading edge to a trailing edge of the blade along the tip of the blade is L1, the gap between the tip of the blade and the casing has a size larger than t0 in at least a part of a range $0<L\leq 0.5L1$.

According to the findings of the inventor of the present application, a phenomenon, in which the blade tip leakage vortex occurs from the leading edge of the blade and the reverse flow starts to occur (the vortex breakdown starts to occur) as the low-energy fluid at a vortex center is overpowered by a pressure gradient, has a tendency to occur within the range $0<L\leq 0.5L1$. Therefore, with a configuration in which the gap between the tip of the blade and the casing has a size larger than t0 in at least a part of the range $0<L\leq 0.5L1$ as described in the above (2), the high-energy clearance flow can be aggressively supplied from the pressure surface of the blade to a region where the phenomenon of starting the occurrence of the reverse flow takes place. Accordingly, by effectively suppressing the breakdown of the blade tip leakage vortex through suppression of the development of the boundary layer on the suction surface of the blade, the reverse flow range in the vicinity of the tip of the blade can be reduced, or the occurrence of the reverse flow can be suppressed. Therefore, the centrifugal compressor with high efficiency can be realized.

(3) In some embodiments, in the compressor described in the above (2), in a size distribution of the gap between the tip of the blade and the casing from the leading edge to the trailing edge, a position where the gap is maximum is within a range $0<L\leq 0.5L1$.

As stated earlier, according to the findings of the inventor of the present application, the phenomenon, in which the blade tip leakage vortex occurs from the leading edge of the blade and the reverse flow starts to occur as the low-energy fluid at the vortex center is overpowered by the pressure gradient, has a tendency to occur within the range $0<L\leq 0.5L1$. Therefore, by setting the position where the aforementioned gap is maximum in the size distribution of the gap to be within the range $0<L\leq 0.5L1$ as described in the above (3), it is possible to effectively suppress the breakdown of the blade tip leakage vortex while suppressing an increase in a leakage loss (a loss attributed to the clearance flow itself), thereby reducing the reverse flow range in the vicinity of the tip of the blade, or suppressing the occurrence of the reverse flow. Therefore, the centrifugal compressor with high efficiency can be realized.

(4) In some embodiments, in the compressor described in any one of the above (1) to (3), in a size distribution of the gap between the tip of the blade and the casing from the leading edge to a trailing edge of the blade, a maximum value $t_{MAX}$ of the gap satisfies $1.1t0\leq t_{MAX}\leq 1.5t0$.

In light of suppression of the increase in the aforementioned leakage loss, it is preferable that the size of the aforementioned gap be basically as small as possible. Furthermore, in light of suppression of the development of the boundary layer on the suction surface of the blade, it is preferable that the maximum value $t_{MAX}$ of the aforementioned gap have a certain level of magnitude. In view of this, by setting the maximum value $t_{MAX}$ of the gap to satisfy $1.1t0\leq t_{MAX}\leq 1.5t0$ as described in the above (4), the centrifugal compressor with high efficiency can be realized while achieving both suppression of the increase in the leakage loss and suppression of the development of the boundary layer on the suction surface of the blade.

(5) In some embodiments, in the compressor described in any one of the above (1) to (4), in a case where a meridional length from the leading edge along the tip of the blade is taken as a horizontal axis and a size of the gap between the tip of the blade and the casing is taken as a vertical axis, a size distribution of the gap from the leading edge to a trailing edge of the blade includes a smooth, curved convex shape with an upward protrusion.

According to the compressor described in the above (5), compared to a case where the configuration of the above (1) is realized with a slit or the like provided on the tip of the blade, the centrifugal compressor with high efficiency can be realized while suppressing an increase in the risk of breakage of the blade.

(6) In some embodiments, in the compressor described in the above (5), in the size distribution of the gap, the curved convex shape exists ranging from the leading edge to the trailing edge.

According to the compressor described in the above (6), the centrifugal compressor with high efficiency can be realized with a simple blade configuration.

(7) In some embodiments, in the compressor described in the above (5), in the size distribution of the gap, the gap has a constant size in a first range from the leading edge, and the curved convex shape exists in a second range downstream of the first range.

According to the compressor described in the above (7), for example, in a case where an inner peripheral surface of the casing is formed so as to be parallel to the axial direction of the rotor in the vicinity of the leading edge of the blade, the centrifugal compressor with high efficiency can be realized with a simple blade configuration.

(8) A turbocharger according to at least one embodiment of the present invention comprises the compressor described in any one the above (1) to (7).

According to the turbocharger described in the above (8), the turbocharger comprising the compressor with high efficiency can be realized.

Advantageous Effects

At least one embodiment of the present invention provides a highly efficient compressor and a turbocharger comprising the same.

DETAILED DESCRIPTION

Figure 1:
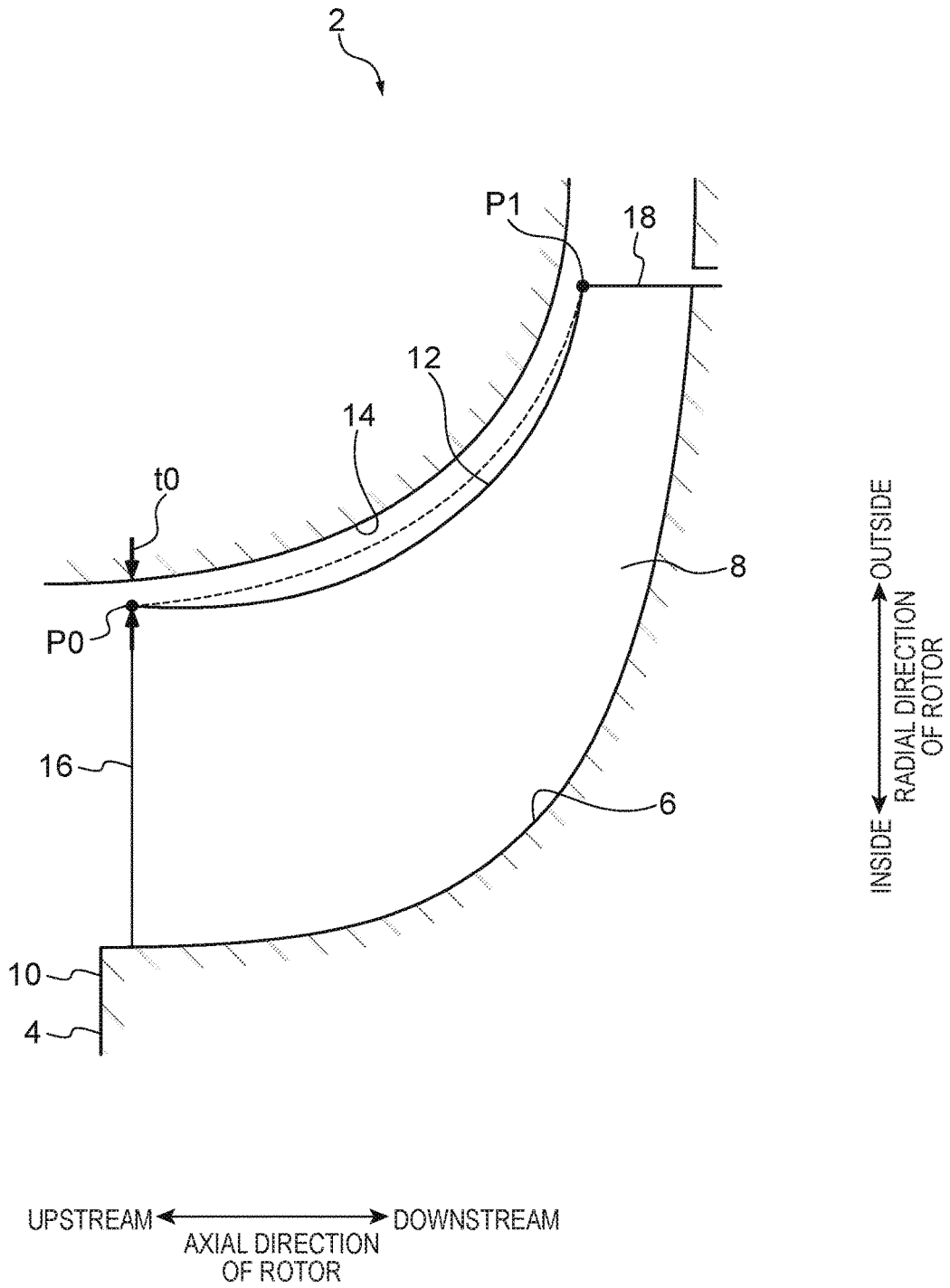
FIG. 1 is a schematic cross-sectional view (meridional view) of a centrifugal compressor 2 according to one embodiment, taken along a rotation axis line.

Hereafter, some embodiments of the present invention will be described with reference to the accompanying drawings. Note that dimensions, materials, shapes, relative positions, and the like of components described as the embodiments or shown in the drawings are not intended to limit the scope of the present invention thereto, and shall be interpreted simply as illustrative.

For example, it is assumed that expressions indicative of relative or absolute positions, such as "in a certain direction", "along a certain direction", "parallel", "perpendicular", "center", "concentric", and "coaxial", not only precisely indicate such positions, but also indicate a state where there is relative displacement based on tolerance, or based on an angle or a distance to the extent that the same function can be achieved.

For example, it is assumed that expressions indicative of a state where matters are equal, such as "the same", "equal", and "uniform", not only precisely indicate the equal state, but also indicate a state where there is difference within tolerance, or a difference to the extent that the same function can be achieved.

For example, it is assumed that expressions indicative of a shape, such as a quadrilateral shape and a cylindrical shape, not only indicate such shapes as a quadrilateral shape and a cylindrical shape in a geometrically precise sense, but also indicate shapes including an uneven portion, a chamfered portion, and the like within a range in which the same advantageous effects can be achieved.

Meanwhile, such expressions as "comprise", "equipped with", "provided with", "include", or "have" a constituent element, are not exclusive expressions that rule out the existence of other constituent elements.

FIG. 1 is a schematic cross-sectional view (meridional view) of a centrifugal compressor 2 according to one embodiment, taken along a rotation axis line. The centrifugal compressor 2 can be applied, for example, to a turbocharger for an automobile, a ship, or a power-generating engine, to an industrial centrifugal compressor, and the like.

As shown in FIG. 1, the centrifugal compressor 2 comprises a rotor 10 and a casing 14, wherein the rotor 10 includes a hub 4 fixed to a non-illustrated rotating shaft and a plurality of blades 8 provided on an outer peripheral surface 6 of the hub 4, while the casing 14 surrounds the rotor 10 so as to face a tip 12 of each blade 8 across a gap. The tip 12 of the blade 8 extends along the casing 14 from a leading edge 16 to a trailing edge 18 of the blade 8.

As shown in FIG. 1, provided that the gap between the tip 12 of the blade 8 and the casing 14 has a size t0 at a leading edge position P0 of the blade 8 (a connecting position between the leading edge 16 and the tip 12 of the blade 8), the gap between the tip 12 of the blade 8 and the casing 14 has a size larger than the size t0 in at least a partial range downstream of the leading edge position P0 in an axial direction of the rotor 10. Note that a dash line in FIG. 1 is a line connecting the positions at a distance of to from the casing 14 in a range from the leading edge position P0 to a trailing edge position P1 (a connecting position between the trailing edge 18 and the tip 12 of the blade 8) of the blade 8, and that this dash line shows a tip shape of a blade in a conventional centrifugal compressor.

Figure 2:
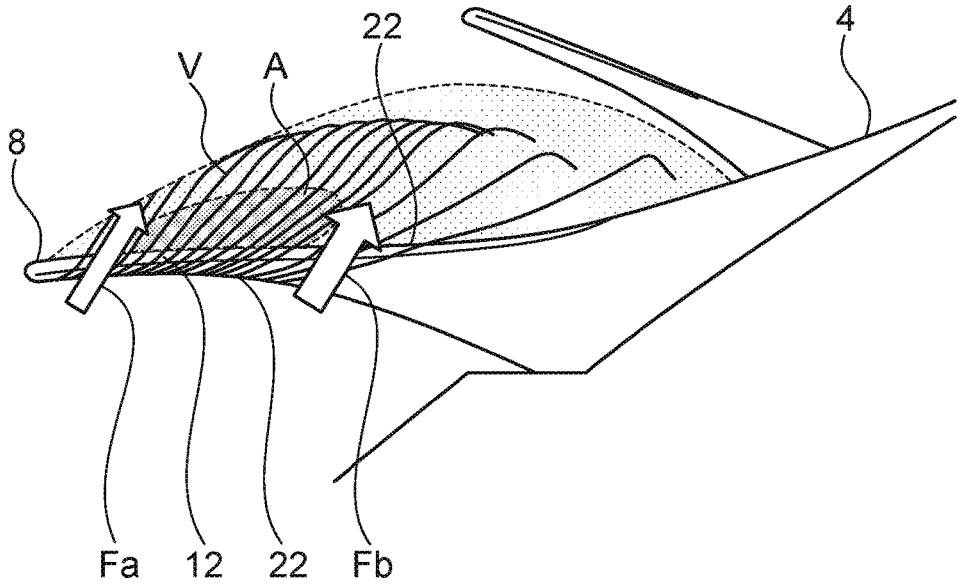
FIG. 2 shows a clearance flow F and a distribution of a reverse flow range A occurring at a suction surface 22 of a blade 8 in the centrifugal compressor 2 according to one embodiment.
Figure 3:
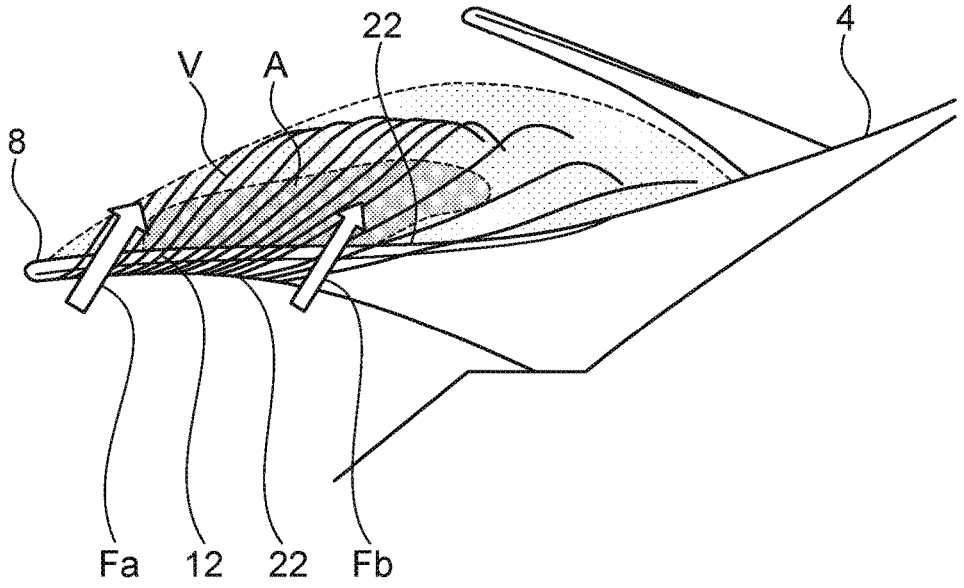
FIG. 3 shows a clearance flow F and a distribution of a reverse flow range A occurring at the suction surface 22 of the blade 8 in a conventional centrifugal compressor (a centrifugal compressor in which a gap between a tip of the blade and a casing is set to have a constant size in a range from a leading edge position to a trailing edge position of the blade as indicated by a dash line in FIG. 1).
Figure 4:
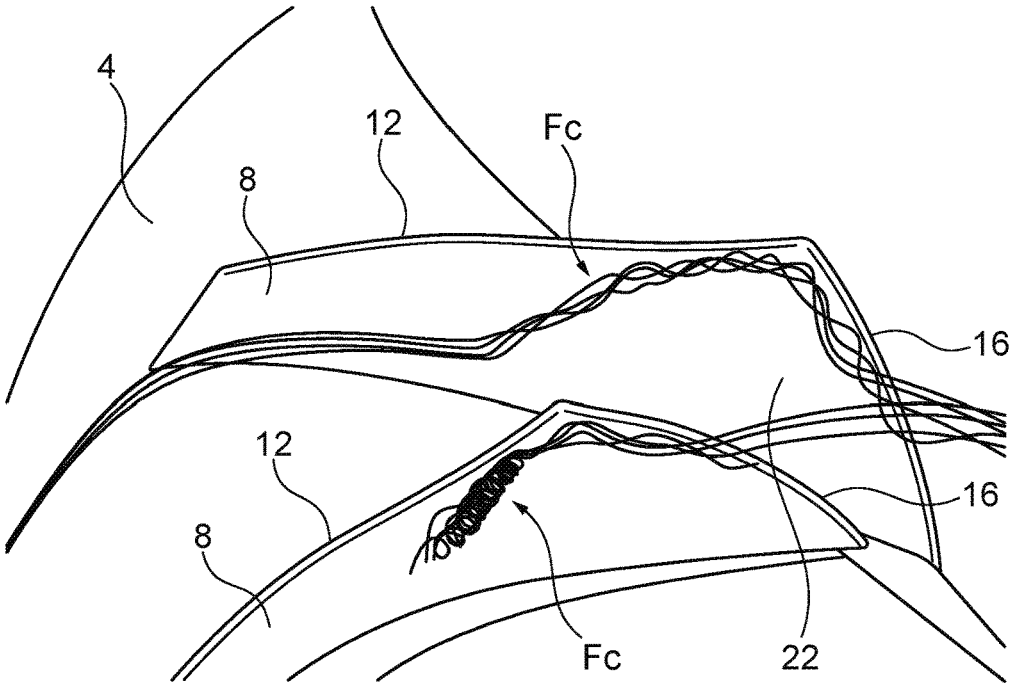
FIG. 4 shows streamlines of a low-energy fluid that deviates from a leading edge and accumulates in the vicinity of the tip of the blade in the centrifugal compressor 2 according to one embodiment.
Figure 5:
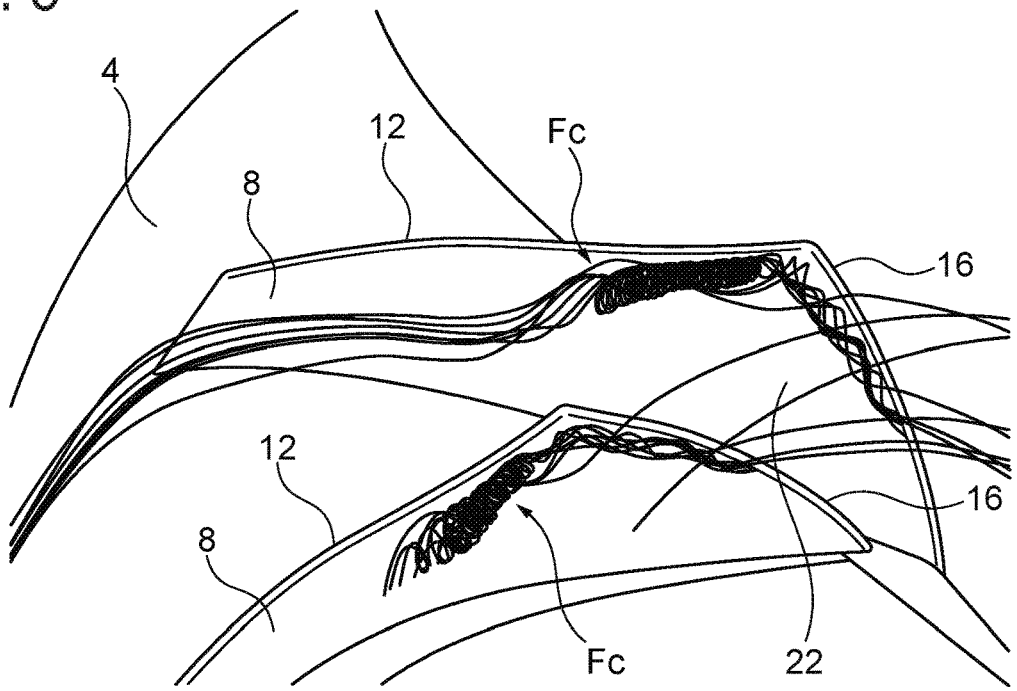
FIG. 5 shows streamlines of a low-energy fluid Fc that deviates from the leading edge and accumulates in the vicinity of the tip of the blade in the conventional centrifugal compressor (the centrifugal compressor in which the gap between the tip of the blade and the casing is set to have a constant size in a range from the leading edge position to the trailing edge position of the blade as indicated by the dash line in FIG. 1).

The advantageous effects achieved by a configuration of the aforementioned centrifugal compressor 2 will be described using FIGS. 2 to 5. FIG. 2 shows a clearance flow and a distribution of a reverse flow range A occurring at a suction surface 22 of the blade 8 in the centrifugal compressor 2 according to one embodiment. FIG. 3 shows a clearance flow and a distribution of a reverse flow range A occurring at the suction surface 22 of the blade 8 in the conventional centrifugal compressor (the centrifugal compressor in which the gap between the tip 12 of the blade 8 and the casing 14 is set to have a constant size in a range from the leading edge position P0 to the trailing edge position P1 of the blade 8 as indicated by the dash line in FIG. 1). FIG. 4 shows streamlines of a low-energy fluid that deviates from the leading edge 16 and accumulates in the vicinity of the tip 12 of the blade 8 in the centrifugal compressor 2 according to one embodiment. FIG. 5 shows streamlines of a low-energy fluid Fc that deviates from the leading edge 16 and accumulates in the vicinity of the tip 12 of the blade 8 in the conventional centrifugal compressor (the centrifugal compressor in which the gap between the tip 12 of the blade 8 and the casing 14 is set to have a constant size in the range from the leading edge position P0 through the trailing edge position P1 of the blade 8 as indicated by the dash line in FIG. 1).

According to the aforementioned centrifugal compressor 2, by keeping the size t0 of the gap between the tip 12 of the blade 8 and the casing 14 small at the leading edge position P0 of the blade 8, an increase in a clearance flow Fa in a portion of a blade tip leakage vortex V where the vortex starts to whirl up can be suppressed, as shown in FIG. 2. This can effectively suppress an increase in a loss attributed to the blade tip leakage vortex V.

Furthermore, as described above, the gap has a size t larger than t0 in at least the partial range downstream of the leading edge position P0 of the blade 8. In this way, as shown in FIGS. 2 and 3, compared to the conventional centrifugal compressor, a clearance flow Fb with high energy can be aggressively supplied from a pressure surface 20 of the blade 8 toward the suction surface 22, at which the low-energy fluid is accumulated, via the gap in at least the partial range mentioned above. Compared to the conventional centrifugal compressor as shown in FIGS. 4 and 5, this can suppress an increase in the amount of the accumulated low-energy fluid Fc in the vicinity of the tip 12 of the blade 8. Therefore, as shown in FIGS. 2 and 3, compared to the conventional centrifugal compressor, by suppressing the breakdown of the blade tip leakage vortex (the occurrence of a reverse flow on a vortex center line) through suppression of the development of a boundary layer on the suction surface 22 of the blade 8, the reverse flow range A in the vicinity of the tip 12 of the blade 8 can be reduced, or the occurrence of a reverse flow can be suppressed.

Furthermore, in a position that is somewhat downstream of the leading edge position P0 of the blade 8, since the pressure difference between the pressure surface 20 and the suction surface 22 is small, even if the size t of the gap in at least the partial range mentioned above is made relatively large, it is possible to effectively reduce the reverse flow range A in the vicinity of the tip 12 of the blade 8, or effectively suppress the occurrence of the reverse flow, without excessively increasing the clearance flow Fb from the gap.

Figure 6:
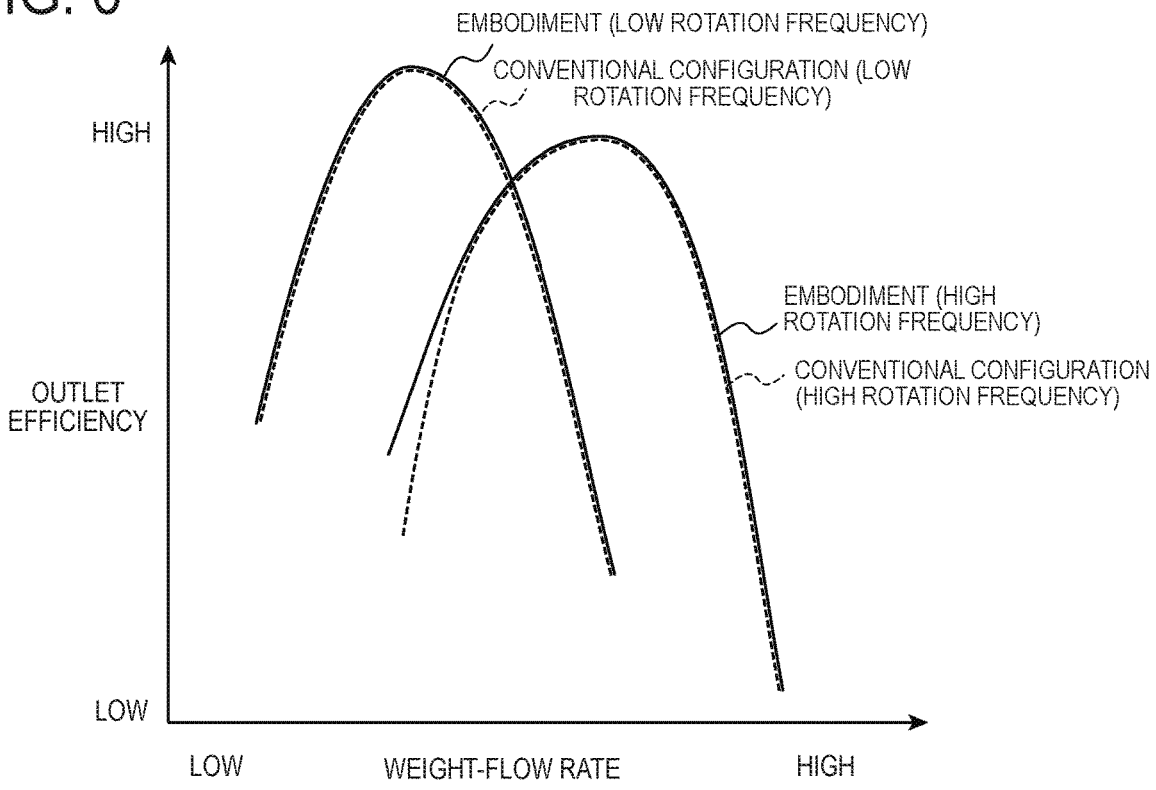
FIG. 6 shows a relationship between a weight-flow rate and outlet efficiency at a high rotation frequency and a low rotation frequency in the centrifugal compressor 2 according to one embodiment and a conventional configuration.
Figure 7:
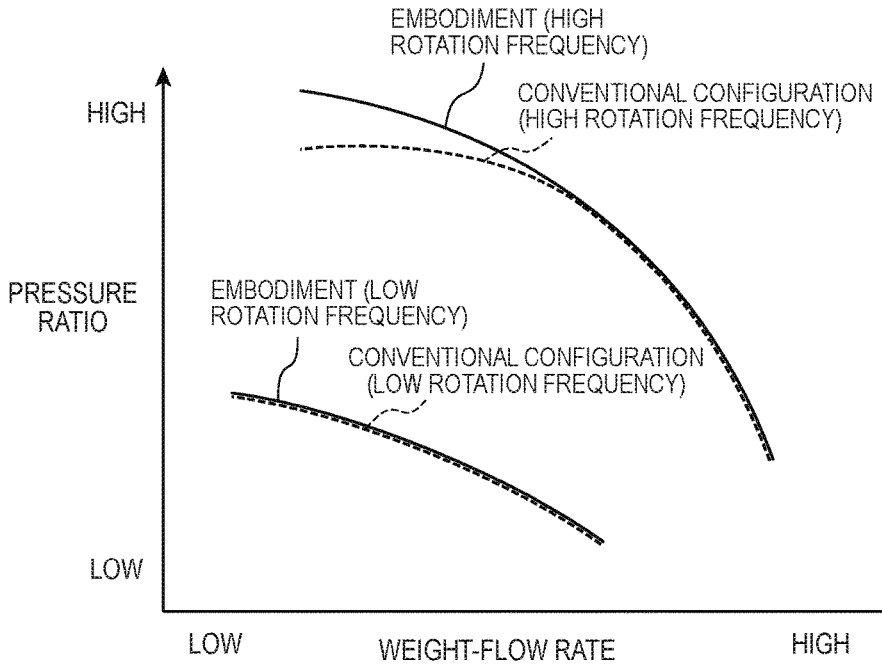
FIG. 7 shows a relationship between the weight-flow rate and a pressure ratio at the high rotation frequency and the low rotation frequency in the centrifugal compressor 2 according to one embodiment and the conventional configuration.

As described above, according to the centrifugal compressor 2, since the reverse flow range in the vicinity of the tip 12 of the blade 8 can be reduced, or the occurrence of the reverse flow can be suppressed, while suppressing an increase in a loss attributed to the clearance flow, the centrifugal compressor with high efficiency can be realized. Furthermore, according to the findings of the inventor of the present application, the performance-enhancing effects are large, especially on a high-pressure ratio side within a high rotation frequency range as shown in FIGS. 6 and 7.

Figure 8:
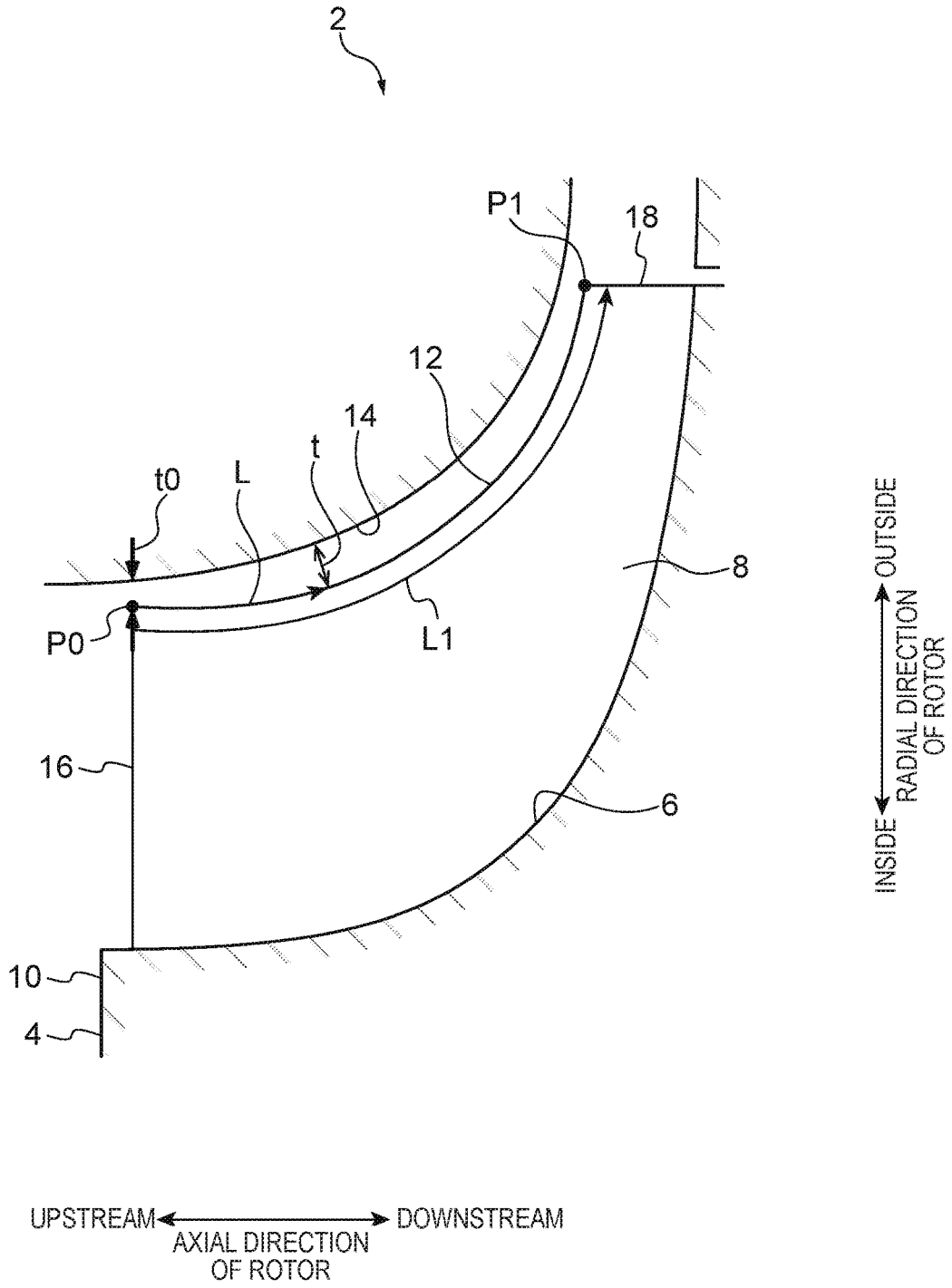
FIG. 8 is a schematic cross-sectional view (meridional view) for describing a configuration of the centrifugal compressor 2 according to one embodiment.
Figure 9:
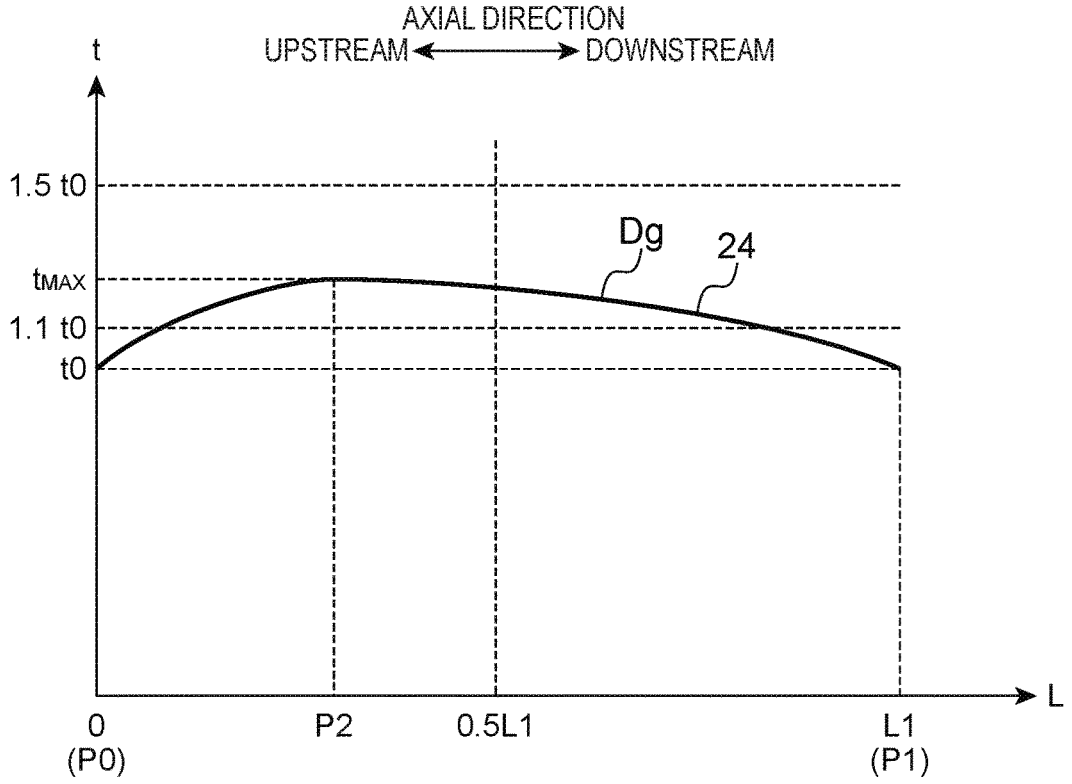
FIG. 9 shows a distribution Dg of a size t of the gap between the tip 12 of the blade 8 and the casing 14 from the leading edge position P0 of the blade 8 to the trailing edge position P1 of the blade 8 in the centrifugal compressor 2 according to one embodiment.

FIG. 8 is a schematic cross-sectional view for describing the configuration of the centrifugal compressor 2 according to one embodiment. FIG. 9 shows a distribution Dg of the size t of the gap between the tip 12 of the blade 8 and the casing 14 from the leading edge position P0 of the blade 8 to the trailing edge position P1 of the blade 8 in the centrifugal compressor 2 according to one embodiment. In FIG. 9, the distribution Dg of the size t of the gap is shown on the assumption that a meridional length L from the leading edge position P0 along the tip 12 of the blade 8 (positions on the meridional length along the tip 12 of the blade 8, provided that the leading edge position P0 serves as an origin) is taken as a horizontal axis, and the size t of the gap between the tip 12 of the blade 8 and the casing 14 is taken as a vertical axis. The "distribution Dg" denotes a line composed of a collection of plotted points, provided that the size t of the gap at various positions on the tip 12 of the blade 8 from the leading edge position P0 of the blade 8 to the trailing edge position P1 of the blade 8 is plotted on the aforementioned horizontal axis and vertical axis. Also, the "meridional length" denotes a length defined on a meridional plane (a view in which the shape of the blade 8 is superimposed on a cross-sectional view of the compressor 2 taken along the rotating shaft line in the form of revolved projection around the rotating shaft line of the rotor 10).

In one embodiment, as shown in FIGS. 8 and 9 for example, provided that the meridional length from the leading edge position P0 along the tip 12 of the blade 8 is L and the meridional length from the leading edge position P0 to the trailing edge position P1 along the tip 12 of the blade 8 is L1, the gap t between the tip 12 of the blade 8 and the casing 14 is larger than the size t0 in at least a part of a range $0<L\leq 0.5L1$.

According to the findings of the inventor of the present application, a phenomenon, in which the blade tip leakage vortex occurs from the leading edge of the blade and the reverse flow starts to occur (the vortex breakdown starts to occur) as the low-energy fluid at a vortex center is overpowered by a pressure gradient, has a tendency to occur within the range $0<L\leq 0.5L1$. Therefore, with the aforementioned configuration in which the gap t between the tip 12 of the blade 8 and the casing 14 has a size larger than the size t0 in at least a part of the range $0<L\leq 0.5L1$ (preferably a range $0.1L1\leq L\leq 0.4L1$, more preferably a range $0.2L1\leq L\leq 0.3L1$), the high-energy clearance flow Fb (see FIG. 2) can be aggressively supplied from the pressure surface 20 of the blade 8 to a region where the phenomenon of starting the occurrence of the reverse flow takes place. Accordingly, by effectively suppressing the breakdown of the blade tip leakage vortex through suppression of the development of the boundary layer on the suction surface 22 of the blade 8, the reverse flow range A in the vicinity of the tip 12 of the blade 8 (see FIG. 2) can be reduced, or the occurrence of the reverse flow can be suppressed. Therefore, the centrifugal compressor with high efficiency can be realized.

In one embodiment, as shown in FIG. 9 for example, in the distribution Dg of the size t of the aforementioned gap, a position P2 of a maximum value $t_{MAX}$ of the gap is within a range $0<L\leq 0.5L1$ (preferably within a range $0.1L1\leq L\leq 0.4L1$, more preferably within a range $0.2L1\leq L\leq 0.3L1$).

As stated earlier, according to the findings of the inventor of the present application, the phenomenon, in which the blade tip leakage vortex occurs from the leading edge of the blade and the reverse flow starts to occur as the low-energy fluid at the vortex center is overpowered by the pressure gradient, has a tendency to occur within the range $0<L\leq 0.5L1$. Therefore, by setting the position P2 of the maximum value $t_{MAX}$ of the aforementioned gap to be within the range $0<L\leq 0.5L1$ in the distribution Dg of the size t of the gap, it is possible to effectively suppress the breakdown of the blade tip leakage vortex while suppressing an increase in a leakage loss (a loss attributed to the clearance flow itself), thereby reducing the reverse flow range A in the vicinity of the tip 12 of the blade 8 (see FIG. 2), or suppressing the occurrence of the reverse flow. Therefore, the centrifugal compressor with high efficiency can be realized.

In one embodiment, in the distribution Dg of the size t of the aforementioned gap, the maximum value $t_{MAX}$ of the gap satisfies $1.1t0\leq t_{MAX}\leq 1.5t0$ as shown in FIG. 9.

In light of suppression of the increase in the aforementioned leakage loss, it is preferable that the size t of the aforementioned gap be basically as small as possible. Furthermore, in light of suppression of the development of the boundary layer on the suction surface 22 of the blade 8, it is preferable that the maximum value $t_{MAX}$ of the aforementioned gap have a certain level of magnitude. In view of this, by setting the maximum value $t_{MAX}$ of the gap to satisfy $1.1t0\leq t_{MAX}\leq 1.5t0$ as stated earlier, the centrifugal compressor with high efficiency can be realized while achieving both suppression of the increase in the leakage loss and suppression of the development of the boundary layer on the suction surface 22 of the blade 8.

In one embodiment, as shown in FIG. 9, the distribution Dg of the size t of the aforementioned gap includes a smooth, curved convex shape 24 with an upward protrusion. According to this configuration, compared to a later-described mode in which a slit 26 or the like is provided on the tip 12 of the blade 8 (see, for example, FIG. 14), the centrifugal compressor with high efficiency can be realized while suppressing an increase in the risk of breakage of the blade.

In one embodiment, in the distribution Dg of the size t of the gap shown in FIG. 9, the curved convex shape 24 exists ranging from the leading edge position P0 to the trailing edge position P1. According to this configuration, the aforementioned centrifugal compressor with high efficiency can be realized with a simple configuration of the blade 8.

The present invention is not limited to the above-described embodiments, and also includes modes in which changes are made to the above-described embodiments and modes in which these modes are combined as appropriate, as will be illustrated hereafter. Hereafter, constituents that have the same names as the aforementioned constituents will be given the same signs, and their basic descriptions will be omitted. The following description will focus on characteristic constituents of each embodiment.

For example, the above-described embodiments have illustrated a mode in which the gap between the tip 12 of the blade 8 and the casing 14 at the trailing edge position P1 of the blade 8 has a size equal to the size t0 of the gap between the tip 12 of the blade 8 and the casing 14 at the leading edge position P0 of the blade 8.

Figure 10:
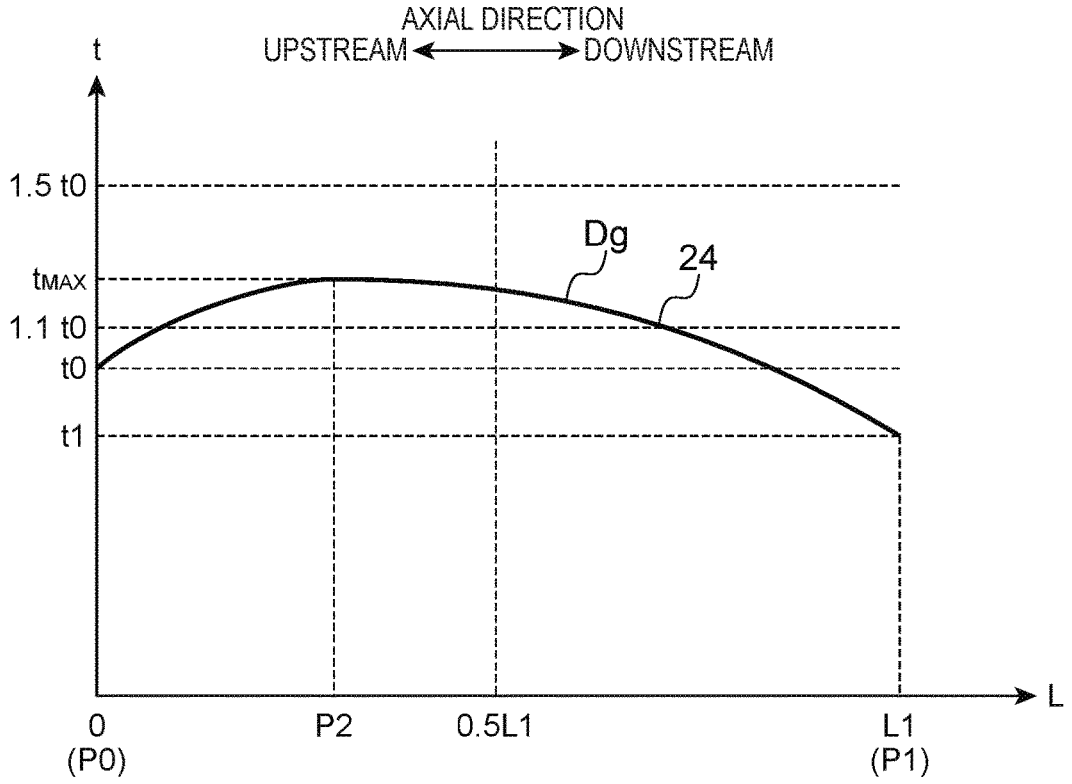
FIG. 10 shows a distribution Dg of the size t of the gap between the tip 12 of the blade 8 and the casing 14 from the leading edge position P0 of the blade 8 to the trailing edge position P1 of the blade 8 in the centrifugal compressor 2 according to one embodiment.

However, the present invention is not limited to this mode. For example, as shown in FIG. 10, the gap between the tip 12 of the blade 8 and the casing 14 at the trailing edge position P1 of the blade 8 may have a size t1 which is smaller than the size t0 of the gap between the tip 12 of the blade 8 and the casing 14 at the leading edge position P0 of the blade 8.

In the centrifugal compressor, in the vicinity of the leading edge position P0 of the blade 8, the size of the gap between the tip 12 of the blade 8 and the casing 14 is likely to change due to the influence of the centrifugal force of the rotor 10, whereas in the vicinity of the trailing edge position P1 of the blade 8, the size of the gap between the tip 12 of the blade 8 and the casing 14 is not likely to be influenced by the centrifugal force of the rotor 10. Therefore, by setting the gap between the tip 12 of the blade 8 and the casing 14 at the trailing edge position P1 of the blade 8 to have the size t1 which is smaller than the size t0 of the gap between the tip 12 of the blade 8 and the casing 14 at the leading edge position P0 of the blade 8 as stated earlier, the loss attributed to the clearance flow can be reduced, and the centrifugal compressor with high efficiency can be realized.

Furthermore, the above-described embodiments have presented a mode in which the curved convex shape 24 exists ranging from the leading edge position P0 to the trailing edge position P1.

Figure 11:
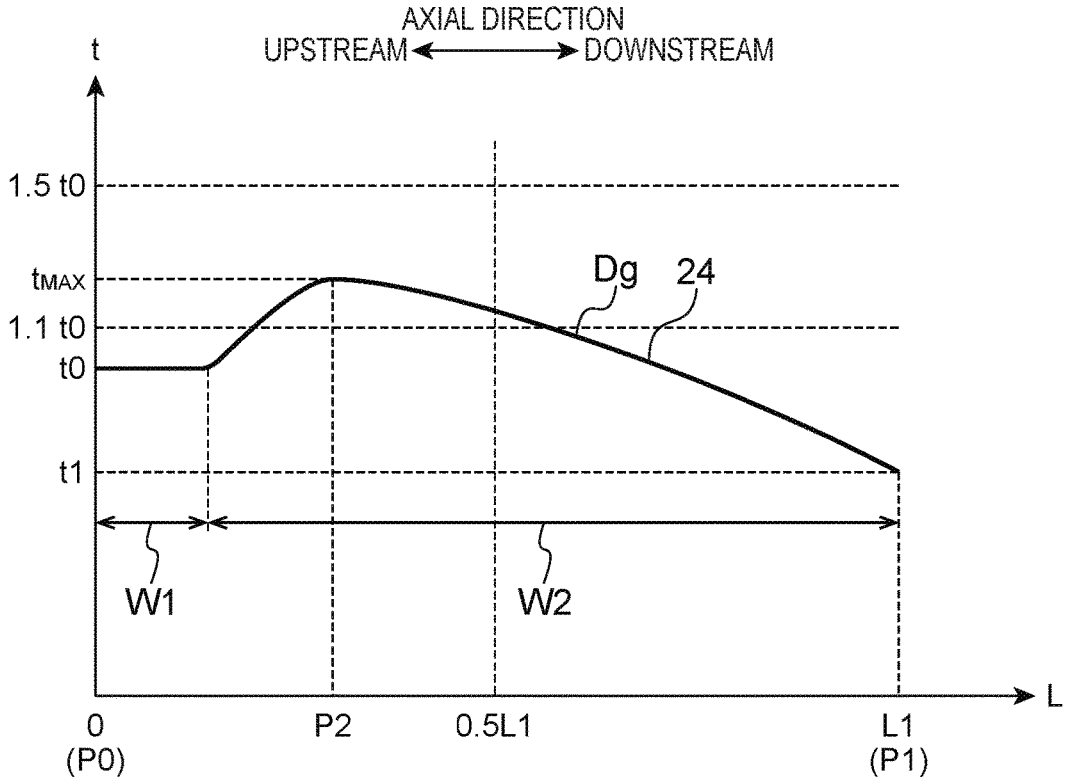
FIG. 11 shows a distribution Dg of the size t of the gap between the tip 12 of the blade 8 and the casing 14 from the leading edge position P0 of the blade 8 to the trailing edge position P1 of the blade 8 in the centrifugal compressor 2 according to one embodiment.

However, the present invention is not limited to this mode. For example, as shown in FIG. 11, in the distribution Dg of the size t of the gap between the tip 12 of the blade 8 and the casing 14 from the leading edge position P0 of the blade 8 to the trailing edge position P1 of the blade 8, the size t of the gap may have a constant size in a first range W1 from the leading edge position P0, and the curved convex shape 24 may exist within a second range W2 downstream of the first range W1.

According to this configuration, for example, in a case where an inner peripheral surface of the casing 14 is formed so as to be parallel to the axial direction of the rotor 10 in the vicinity of the leading edge position P0 of the blade 8, the centrifugal compressor with high efficiency can be realized with a simple blade configuration.

Furthermore, although the above-described embodiments illustrated a case where the present invention is applied to the centrifugal compressor 2, the present invention is not limited to this mode, and may be applied to an axial compressor 3.

Figure 12:
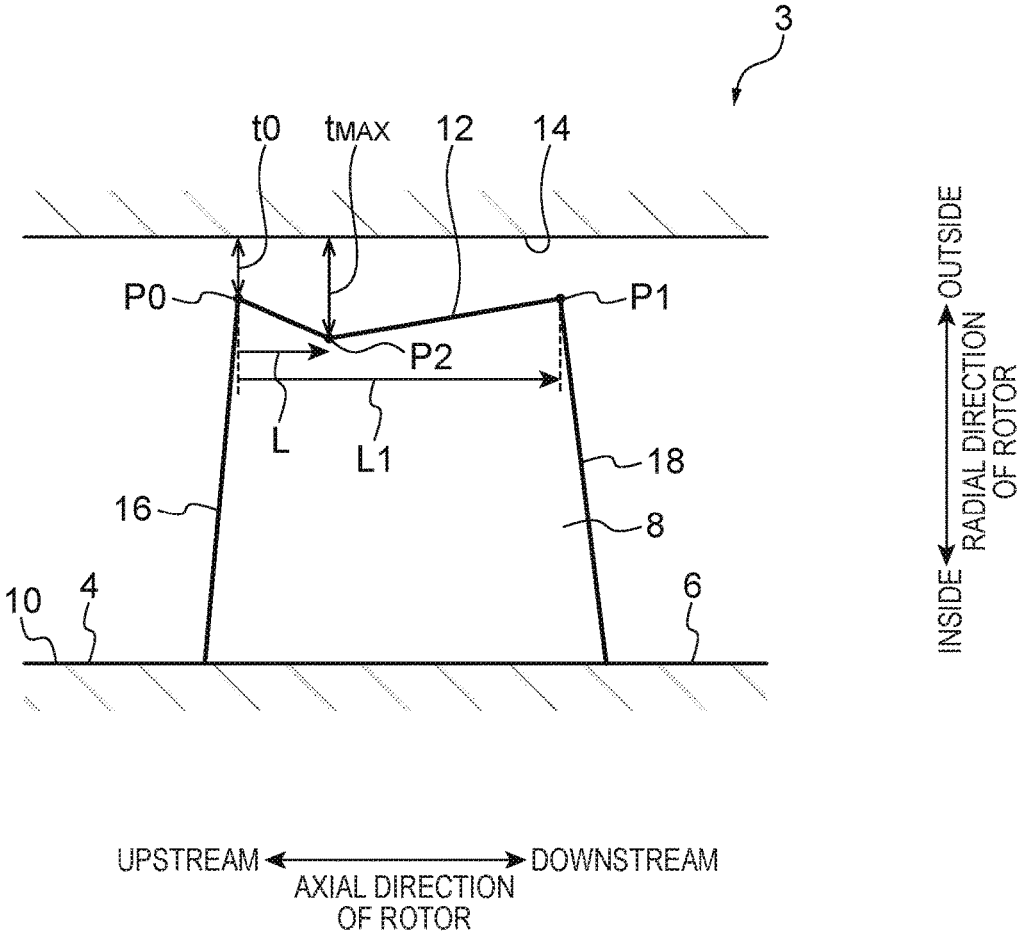
FIG. 12 is a schematic cross-sectional view (meridional view) of an axial compressor 3 according to one embodiment, taken along a rotation axis line.
Figure 13:
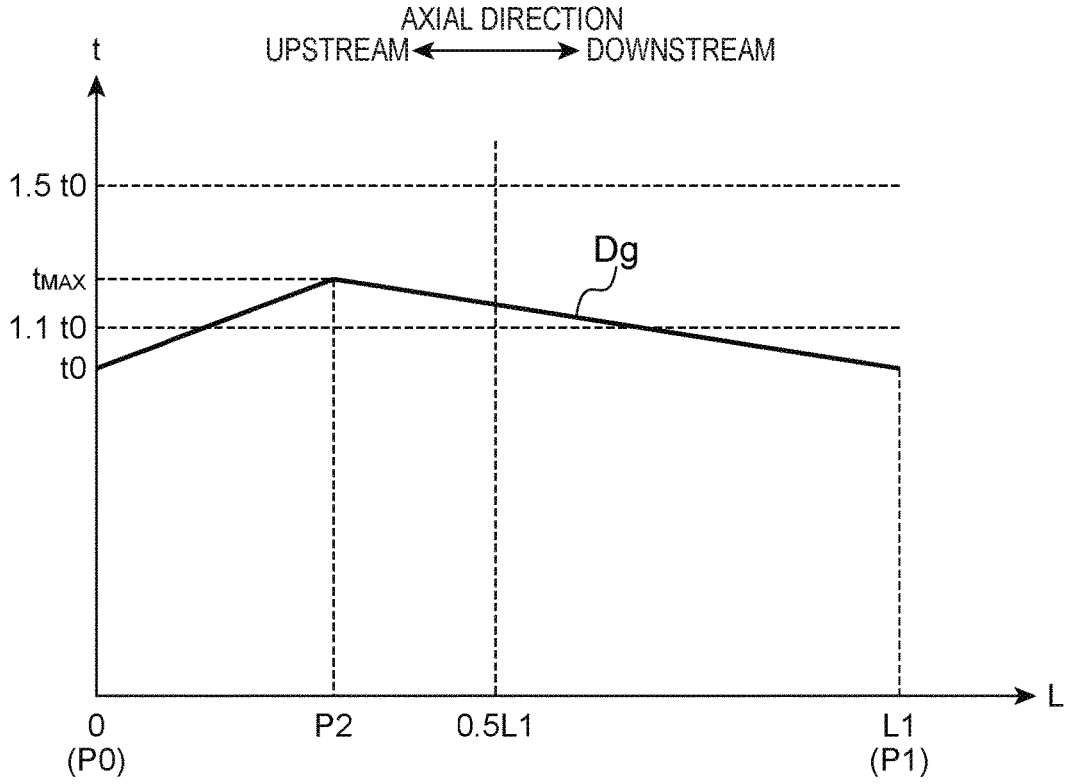
FIG. 13 shows a distribution Dg of the size t of the gap between the tip 12 of the blade 8 and the casing 14 from the leading edge position P0 of the blade 8 to the trailing edge position P1 of the blade 8 in the axial compressor 3 according to one embodiment.

In this case, as shown in FIGS. 12 and 13 for example, in the distribution Dg of the size t of the gap between the tip 12 of the blade 8 and the casing 14 from the leading edge position P0 of the blade 8 to the trailing edge position P1 of the blade 8, the size t of the gap may linearly increase from the leading edge position P0 of the blade 8 toward the downstream side in the axial direction to reach the maximum value $t_{MAX}$, and linearly decrease from the position P2 of the maximum value $t_{MAX}$ toward the downstream side in the axial direction.

Figure 14:
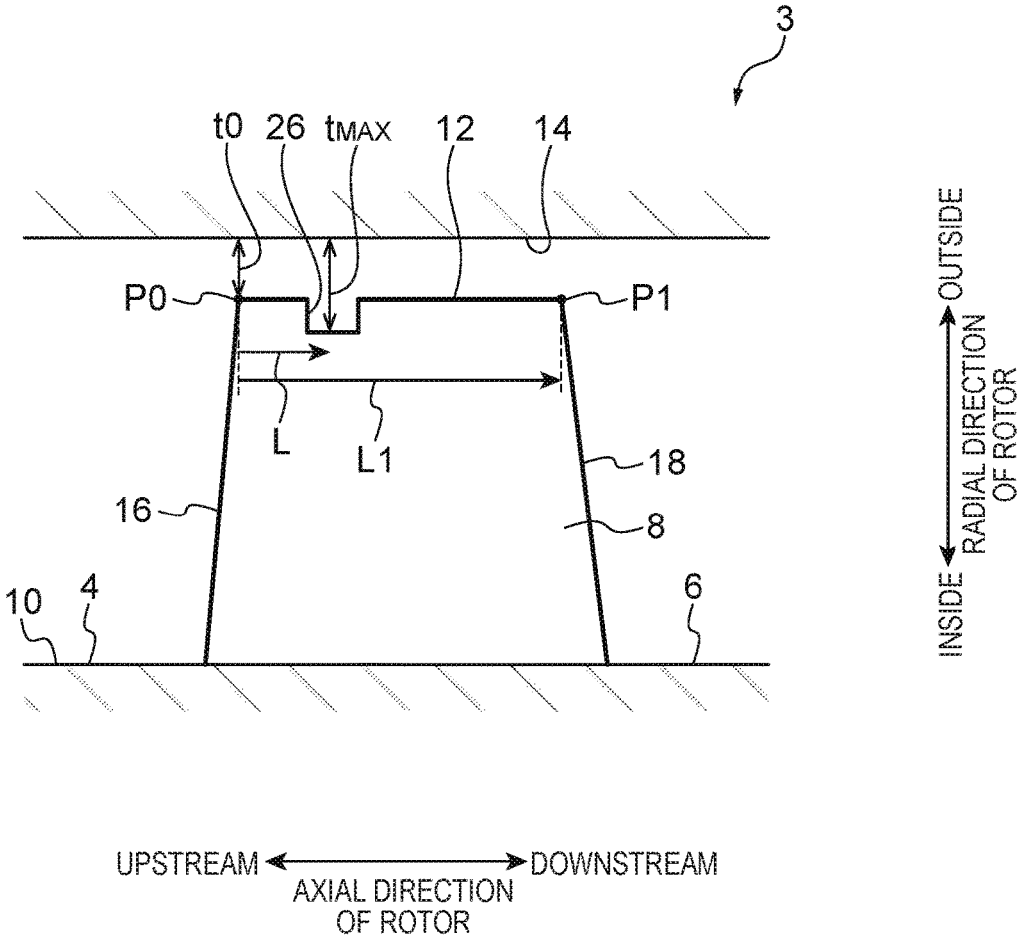
FIG. 14 is a schematic cross-sectional view (meridional view) of the axial compressor 3 according to one embodiment, taken along the rotation axis line.
Figure 15:
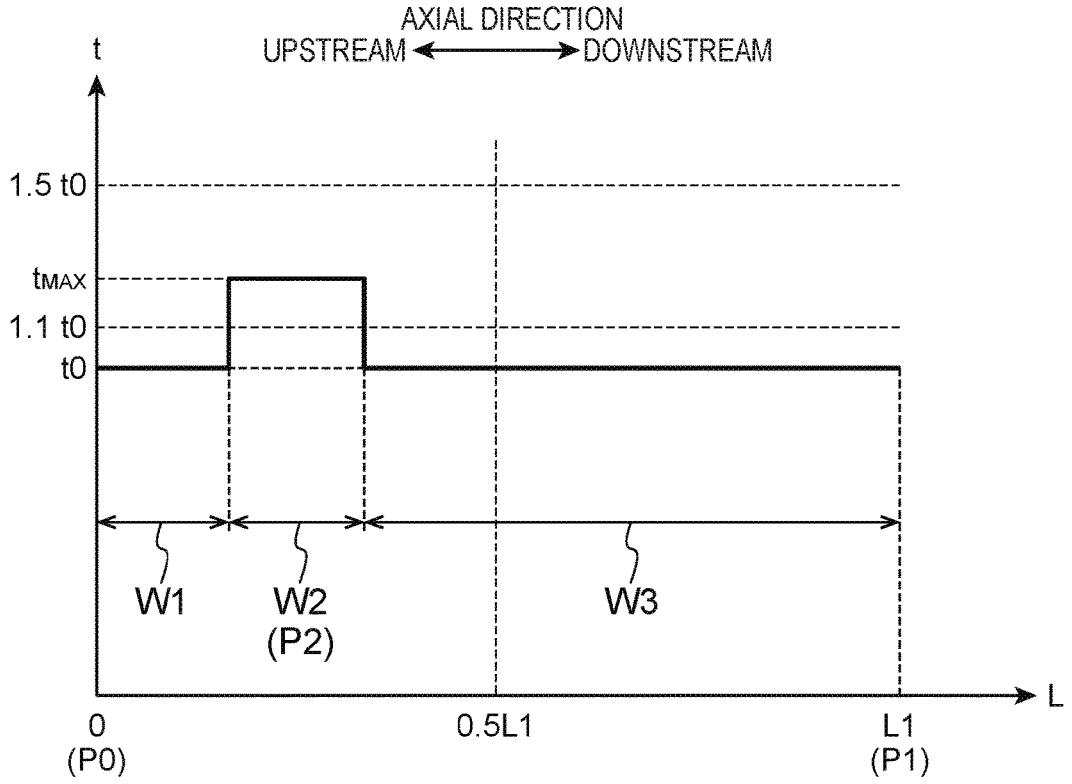
FIG. 15 shows a distribution Dg of the size t of the gap between the tip 12 of the blade 8 and the casing 14 from the leading edge position P0 of the blade 8 to the trailing edge position P1 of the blade 8 in the axial compressor 3 according to one embodiment.

Furthermore, as shown in FIGS. 14 and 15 for example, in the distribution Dg of the size t of the gap between the tip 12 of the blade 8 and the casing 14 from the leading edge position P0 of the blade 8 to the trailing edge position P1 of the blade 8, the size t of the gap may change in a discontinuous manner. In a mode shown in FIGS. 14 and 15, a slit 26 is provided on the tip 12 of the blade 8, and the size t of the gap has: the constant value t0 in a first range W1 from the leading edge position P0; the constant maximum value $t_{MAX}$ in a second range W2 (a range in which the slit 26 is provided) that is downstream of and adjacent to the first range W1; and the constant value t0 in a third range W3 that is downstream of and adjacent to the second range W2.

Also, in some embodiments shown in FIGS. 10 to 15, in at least a partial range further downstream of the leading edge position P0 of the blade 8 in the axial direction of the rotor 10, the gap between the tip 12 of the blade 8 and the casing 14 has a size larger than the size t0 of the gap between the tip 12 of the blade 8 and the casing 14 at the leading edge position P0. Accordingly, the development of the boundary layer on the suction surface 22 of the blade 8 can be suppressed while suppressing the increase in the leakage loss, and the centrifugal compressor with high efficiency can be realized.

REFERENCE SIGNS LIST

2 Centrifugal compressor
3 Axial compressor
4 Hub
6 Outer peripheral surface
8 Blade
10 Rotor
12 Tip
14 Casing
16 Leading edge
18 Trailing edge
20 Pressure surface
22 Suction surface
24 Curved convex shape
26 Slit

The invention claimed is:

1. A centrifugal compressor, comprising:

a rotor including a hub and a blade provided on an outer peripheral surface of the hub, the outer peripheral surface of the hub is formed in a concave shape in cross section along the rotational axis of the rotor; and a casing surrounding the rotor so as to face a tip of the blade across a gap, wherein provided that the gap between the tip of the blade and the casing has a size t0 at a leading edge of the blade, the gap between the tip of the blade and the casing has a size larger than t0 in at least a partial range downstream of the leading edge in an axial direction of the rotor, wherein in a size distribution of the gap between the tip of the blade and the casing from the leading edge to a trailing edge of the blade, a maximum value $t_{MAX}$ of the gap satisfies $1.1t0 \leq t_{MAX} \leq 1.5t0$, and wherein in a case where a meridional length from the leading edge along the tip of the blade is taken as a horizontal axis and a size of the gap between the tip of the blade and the casing is taken as a vertical axis, a size distribution of the gap from the leading edge to the trailing edge of the blade includes a smooth, curved convex shape with an upward protrusion.

2. The centrifugal compressor according to claim 1, wherein provided that a meridional length from the leading edge along the tip of the blade is L and that a meridional length from the leading edge to the trailing edge of the blade along the tip of the blade is L1, the gap between the tip of the blade and the casing has a size larger than t0 in at least a part of a range $0<L\leq 0.5L1$.

3. The centrifugal compressor according to claim 2, wherein in a size distribution of the gap between the tip of the blade and the casing from the leading edge to the trailing edge, a position where the gap is maximum is within a range $0<L\leq 0.5L1$.

4. The centrifugal compressor according to claim 1, wherein in the size distribution of the gap, the curved convex shape exists ranging from the leading edge to the trailing edge.

5. The centrifugal compressor according to claim 1, wherein in the size distribution of the gap, the gap has a constant size in a first range from the leading edge, and the curved convex shape exists in a second range downstream of the first range.

6. A turbocharger comprising:

the centrifugal compressor according to claim 1.

7. A centrifugal compressor, comprising:

a rotor including a hub and a blade provided on an outer peripheral surface of the hub, the outer peripheral surface of the hub is formed in a concave shape in cross section along the rotational axis of the rotor; and a casing surrounding the rotor so as to face a tip of the blade across a gap, wherein provided that the gap between the tip of the blade and the casing has a size t0 at a leading edge of the blade, the gap between the tip of the blade and the casing has a size larger than t0 in at least a partial range downstream of the leading edge in an axial direction of the rotor, wherein in a size distribution of the gap between the tip of the blade and the casing from the leading edge to a trailing edge of the blade, a maximum value $t_{MAX}$ of the gap satisfies $1.1t0<t_{MAX}\leq 1.5t0$, and wherein the gap between the tip of the blade and the casing at the trailing edge position of the blade have a size that is smaller than the size t0.

* * * * *